US010041231B2

(12) United States Patent
Knight et al.

(10) Patent No.: US 10,041,231 B2
(45) Date of Patent: Aug. 7, 2018

(54) EXCAVATOR TOOTH RETENTION APPARATUS

(71) Applicant: Raptor Mining Products Inc., Edmonton (CA)

(72) Inventors: Garrett D. Knight, Kincardine (CA); Murray A. Smith, Oro Medonte (CA)

( * ) Notice: Subject to any disclaimer, the term of this patent is extended or adjusted under 35 U.S.C. 154(b) by 0 days.

(21) Appl. No.: 15/499,266

(22) Filed: Apr. 27, 2017

(65) Prior Publication Data

US 2017/0314235 A1 Nov. 2, 2017

Related U.S. Application Data

(60) Provisional application No. 62/391,362, filed on Apr. 28, 2016.

(51) Int. Cl.
*E02F 9/28* (2006.01)
*E02F 3/40* (2006.01)

(52) U.S. Cl.
CPC ..... *E02F 9/2825* (2013.01); *E02F 9/2808* (2013.01); *E02F 9/2833* (2013.01); *E02F 3/401* (2013.01)

(58) Field of Classification Search
CPC ..... E02F 9/2833; E02F 9/2841
See application file for complete search history.

(56) References Cited

U.S. PATENT DOCUMENTS 3,191,323 A * 6/1965 Compagnoni ..... E02F 9/2833 172/762
5,077,918 A * 1/1992 Garman ..... E02F 9/2808 172/701.3
5,937,550 A * 8/1999 Emrich ..... E02F 9/2841 37/456
5,956,874 A 9/1999 Ianello et al.
6,108,950 A * 8/2000 Ruvang ..... E02F 9/2825 37/452
6,757,995 B2 * 7/2004 Pippins ..... E02F 9/2875 172/683
7,032,334 B2 * 4/2006 Pippins ..... E02F 9/2833 37/455
7,313,877 B2 * 1/2008 Clendenning ..... E02F 9/2833 37/456
8,458,931 B2 6/2013 Knight
8,701,586 B2 4/2014 Harder et al.
8,931,190 B2 1/2015 Knight
9,441,352 B2 * 9/2016 Bilal ..... E02F 9/2841
9,920,504 B2 * 3/2018 Bierwith ..... E02F 9/2841
(Continued)

FOREIGN PATENT DOCUMENTS

AU 2005203717 * 3/2006

*Primary Examiner* — Matthew D Troutman

(57) ABSTRACT

A tooth adapter defining top and bottom walls and side walls, an adapter recess in one side, a retention means in the adapter recess, a bolt with a fastening inserted in the recess, a collar formed on the bolt of predetermined diameter, a tooth having side walls and defining a hollow chamber fitting over the adaptor, a through tooth bolt opening formed in a tooth side wall of predetermined diameter, the tooth bolt opening being located to register with the adaptor recess, when the tooth is positioned on the adapter.

In one version the diameter of the collar is slightly greater than the diameter of the tooth bolt opening, to create a locking effect.

5 Claims, 6 Drawing Sheets

(56) References Cited

U.S. PATENT DOCUMENTS

| | | | | |
|---|---|---|---|---|
| 2002/0000053 | A1* | 1/2002 | Adamic | E02F 9/2825 37/456 |
| 2009/0205228 | A1* | 8/2009 | Ruvang | E02F 9/2833 37/456 |
| 2010/0257759 | A1* | 10/2010 | Ko | E02F 9/2825 37/456 |
| 2014/0366409 | A1* | 12/2014 | Simpson | E02F 9/2825 37/456 |
| 2018/0044894 | A1* | 2/2018 | Tuto | E02F 9/2841 |

* cited by examiner

EXCAVATOR TOOTH RETENTION APPARATUS

This application is based on U.S. provisional application Ser. No. 62/391,362 entitled Excavator Tooth Retention Apparatus, filed Apr. 28 2016, the priority of which is claimed.

FIELD OF THE INVENTION

The invention relates to an excavator, and in particular to a retention apparatus for such an excavator for holding replaceable members on the excavator shovel, such as the teeth or tooth adapters on the shovel.

BACKGROUND OF THE INVENTION

An excavator such as is used in mining, construction and the like, has at least one shovel for scooping up rock, earth, or debris. The shovel has a series of spaced apart teeth. The teeth are supported on tooth adapters. The tooth adapters are secured to support bodies on the leading edge of the shovel.

In most cases the excavator teeth are subjected to rapid wear. They will need to be replaced, sometimes at frequent intervals. The teeth were often secured on the adapters simply by wedges and spools. The teeth could be removed in many cases by a hammer, and replaced as needed. The tooth adapters are also removably attached to support bodies on the shovel. The adapters are also subject to wear and are replaceable from time to time.

For the purposes of this patent both the teeth themselves and also the tooth adapters are collectively referred to as teeth, it being understood that the invention is applicable with equal force to retaining the teeth on the adapters, and also in some cases to retaining the adapters on the shovel, where this facility is applicable.

Some manufacturers have developed various different retention systems, but most are inconvenient, and time consuming to use. Where the shovel is being forced into a pile of material, the forces tend to push the teeth more securely onto their adapters and the adapters onto the shovel.

However, depending on the particular operations being carried out, the teeth can become loose and fall off. In almost all cases the act of dumping the contents out of the shovel resulted in friction forces also tending to dislodge the teeth.

The movement of the material exerts forces on the teeth tending to remove them from the adapters.

The invention is directed to a tooth retention apparatus, retaining the teeth on their adapters, and the adapters on the shovel, where applicable, while being relatively uncomplicated for service persons to remove and replace the teeth when required.

The invention is equally applicable to retaining the adapters on shovel support bodies, where the adapters and the shovel support bodies will accept it.

BRIEF SUMMARY OF THE INVENTION

With a view to providing such an apparatus, the invention comprises a tooth adapter defining top and bottom walls and side walls, an adapter recess in one side, a retention means in the adapter recess, a bolt with a fastening inserted in the recess, a collar formed on the bolt of predetermined diameter, a tooth having side walls and defining a hollow chamber fitting over said adapter, a through tooth bolt opening formed in a tooth side wall of predetermined diameter, said tooth bolt opening being located to register with said adapter recess, when the tooth is positioned on the adapter.

In one version the diameter of the collar is slightly greater than the diameter of the tooth bolt opening, to create a locking effect.

The bolt is screwed flush into the adapter recess before the tooth is fitted onto the adapter. The tooth is then fitted onto the adapter. When the tooth bolt opening and the adapter recess are more of less in registration, the bolt is unthreaded, partially, by means of a suitable tool. The free end of the bolt will then be partly extended out of the adapter recess and will enter the tooth bolt opening thus prevent the tooth from slipping off the adapter.

The bolt of the tooth retention device has a predetermine diameter D1.

The tooth bolt defines an outer locking end and an inner securing end.

A collar is formed intermediate the two ends of the bolt and has a larger diameter D2, greater than the bolt diameter D1.

The head of the bolt is sized to enter the tooth bolt opening, holding the tooth on the adapter.

However, as the bolt in unthreaded, the collar will catch on the edge of the tooth around the tooth bolt opening and prevent further unthreading. This will prevent the bolt from becoming loose from its adapter recess.

Preferably the recess in the adapter has an internal bore with a diameter at least equal to D2 so as to allow the bolt and the collar to be retracted flush.

The tooth bolt opening which extends through the side wall from the inside on the tooth to the outside preferably has an internal diameter approximately equal to D1. This is to accept the bolt locking end portion in the tooth bolt opening when the bolt is extended from the adapter but to be insufficient to allow entry of the collar.

A compression spring is located inside the adapter recess and engages the inner securing end of the bolt, to resist inadvertent rotation of the bolt during use.

A removable plug of resilient material will plug the tooth bolt opening to prevent entry of foreign material.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
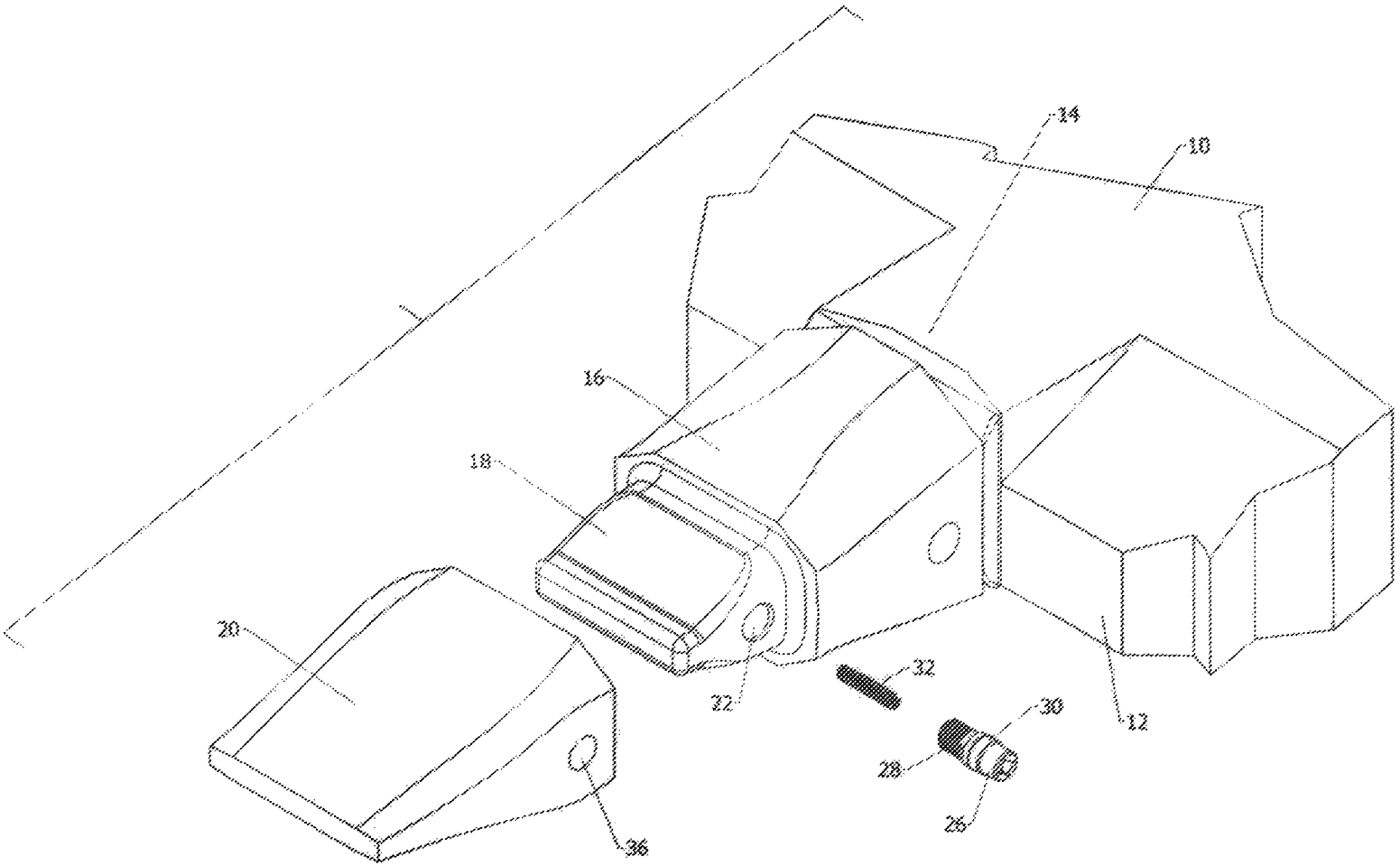
FIG. 1 is an exploded view of part of the edge of the shovel, the adapter, and the tooth.
Figure 2:
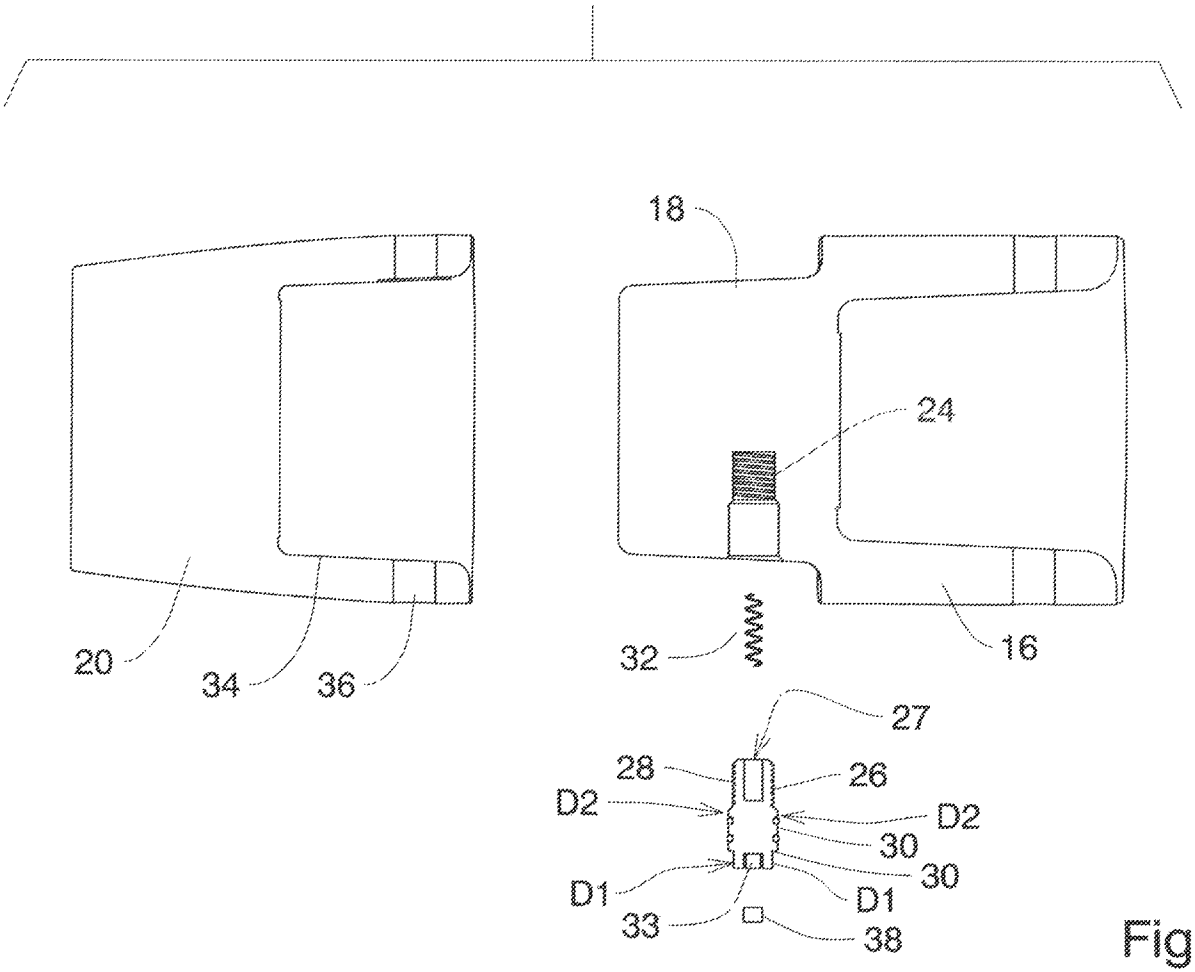
FIG. 2 is a section along the line 2-2 of FIG. 1.
Figure 3:
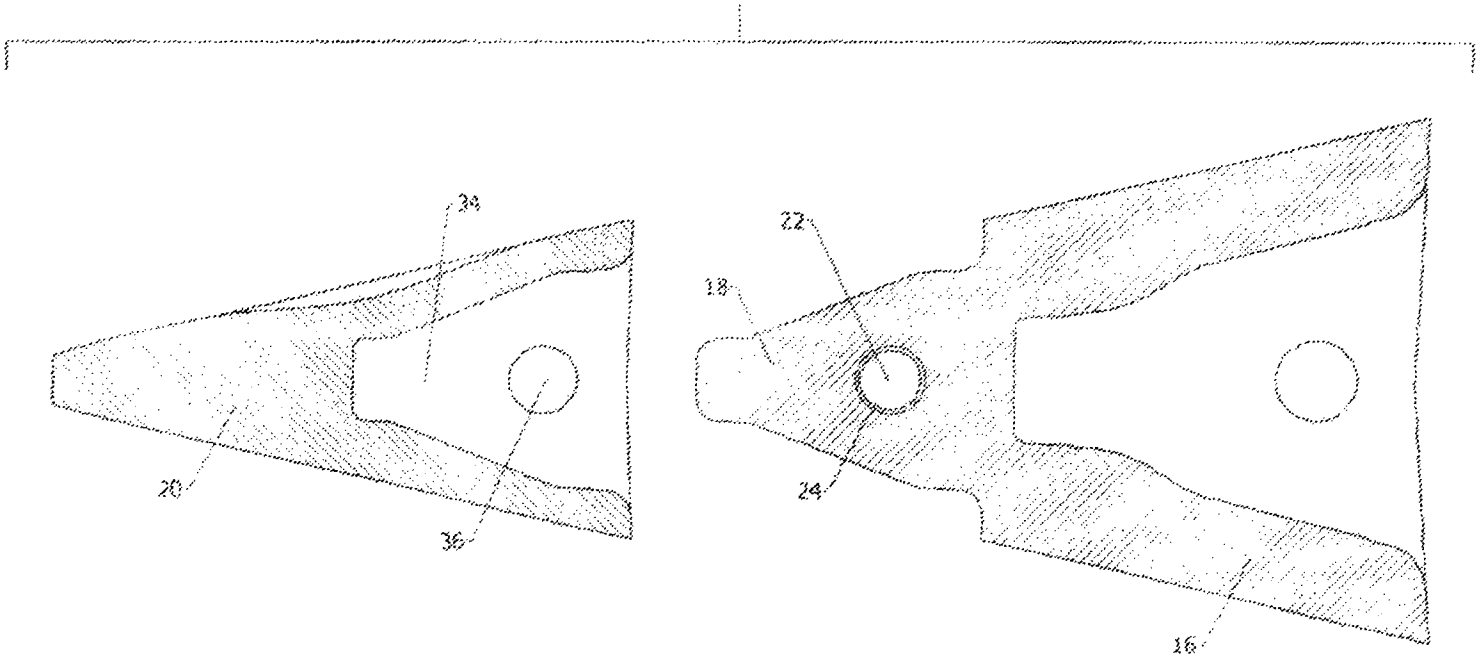
FIG. 3 is a section along the line 3-3 of FIG. 1.

FIG. 1 shows a portion of a shovel or bucket (10). The shovel has a leading edge (12) which is usually the lower edge, but may be the upper edge in some cases. It is this edge that suffers the most wear. During thrusting forward of the shovel the edge will be forced into the pile of material to be moved.

The edge of the shovel is provided with forwardly projecting support bodies or noses (14). Tooth adapters (16) are removably fastened to the noses (14). The adapters (16) have forward projections or tongues (18) of predetermined tapering shape. Teeth (20) are hollow shell like structures with walls enclosing a chamber, and terminating in a forwardly directed blade portion. The hollow teeth are slid onto forward projections (18) of adapters (16).

The projections (18) have adapter recesses (22) in one side. Recesses (22) are formed with interior retention means in this case fastening threads (24). Typically these are female threads, but other fastenings could be used in their place.

Bolts (26) define an inner end and an outer end. The bolts preferably have a partial drilling or counterbore (27) at their inner securing ends, and have bolt fastenings or threads (28). Typically these are male threads, complimentary to the female threads (24). However other fastening systems are possible, the fasteners (24) and (28) being complimentary with one another.

Collars (30) are formed on bolts (26), part way between the bolt head (29) at the bolt outer locking end and the male threaded securing portion at the bolt inner end. Bolt head (29) has a predetermined exterior diameter D1 and the collars have a diameter D2 greater than the bolt head diameter D1.

The portion of the bolt from the collar to the bolt head at its outer end is referred to as the locking portion of the bolt. The portion of the bolt from the collar to the inner end is referred to as the securing portion.

A compression spring (32) is located inside recess (22) and is fitted into partial drilling (27).

A drive key (33) Is formed in or on the bolt head at the outer end of the bolt, of any suitable shape, such as square, or angular or a slot, to receive a suitable drive tool or key (not shown) such as an allan key, screw driver or suitable wrench.

The adapter recess (22) has an internal diameter with a counter bore equal to or greater than D2 so as to receive both the bolt (26) and the collar (30), and allow them to be screwed in with the bolt head flush with the adapter.

The bolt (26) can be inserted into the adapter recess (22) in forward projection (18) of adapter (16). By tightening the bolt into the threads (24) the spring (32) is compressed. The collar (30) is then received in the outer end bore in the adapter recess (22) until the bolt head (29) is flush within the recess (22), and does not extend out of the adapter projection (18).

The tooth (20) has side walls enclosing a hollow interior chamber (34), for fitting over projection (18) There is at least one tooth bolt opening (36) in the tooth. Preferably there are tooth bolt openings (36) in each side wall of the tooth.

The tooth bolt openings in the tooth extend completely through the side walls from the inside of the chamber to the outside so that each tooth bolt opening defines an open inner end and open outer end. The tooth bolt openings preferably have an internal diameter approximately equal to D1 so as to allow the bolt head and locking portion of the bolt (26) to be extended into the tooth bolt opening (36), but insufficient to allow entry of the collar (30).

When the tooth is fitted onto the adapter projection (18), one tooth bolt opening (36) will more or less register with the adapter recess (22).

A suitable tool (not shown) is then inserted through the open outer end of the tooth bolt opening (36), to engage the head of the bolt (26). The bolt (26) can then be rotated and partially unthreaded. This will extend the bolt head and locking portion of bolt (26) out of the adapter recess (22) and drive that portion of it into the tooth bolt opening (36) in the tooth.

This will lock the tooth on the adapter, secure against normal forces encountered during operation.

The collar (30) will not enter the opening (36). The collar will engage the edge of the tooth around opening (36) and thus prevent the securing portion of the bolt (26) from being completely removed from the adapter recess (22).

This is the preferred case.

However there may be some adjustment or approximation possible in these openings.

For simplicity it may be suitable to make both the adapter recess and the tooth bolt opening of equal diameters.

In many cases the tooth bolt openings in the tooth will not quite register perfectly with the adapter recess. Thus when the bolt is unthreaded from the adapter recess, the locking portion of the bolt will be able to enter the tooth bolt opening, but, due to the imperfect registration, the collar will engage against the outside of the tooth wall, and prevent further unthreading of the bolt.

When the shovel is forced into the pile of material, the forces will push the tooth onto the adapter projection.

When the shovel is withdrawn there will be some forces trying to loosen the tooth and remove it.

These removal forces will be resisted by the engagement of the bolt locking portion, in the tooth bolt opening (36) in the tooth. When it is time to replace a tooth, the service person will simply reach through the open end of the tooth bolt opening with a tool and screw the bolt (26) back into the adapter recess (22), until it is clear of the tooth bolt opening (36) in the tooth (20) The tooth can then be removed from the adapter in the normal way.

In order to keep dirt out of the tooth bolt opening and the bolt head a synthetic plug (38) of resilient material such as silicone or rubber can be inserted into the outer open end of the tooth bolt opening (36).

In order to prevent dirt getting in behind the bolt (26) during operation, an O-ring seal on the outside diameter of the bolt (26) will seal the interior diameter of the adapter recess (22).

In some cases the teeth are of a design that enables them to be used either rotated up or rotated down. This can give the teeth a longer working life.

For this reason the teeth are provided with tooth bolt openings (36) in both side walls of the chamber as described.

Once a tooth becomes badly worn on one surface, it can simply be removed and rotated and replaced on its adapter.

Figure 4:
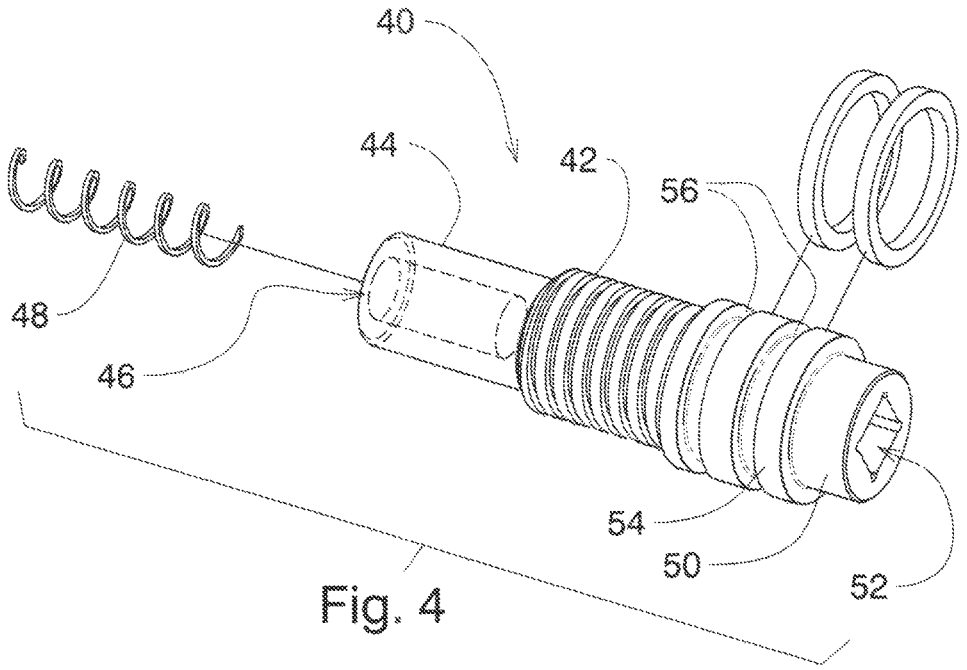
FIG. 4 is an exploded perspective of an alternate embodiment of bolt.
Figure 5:
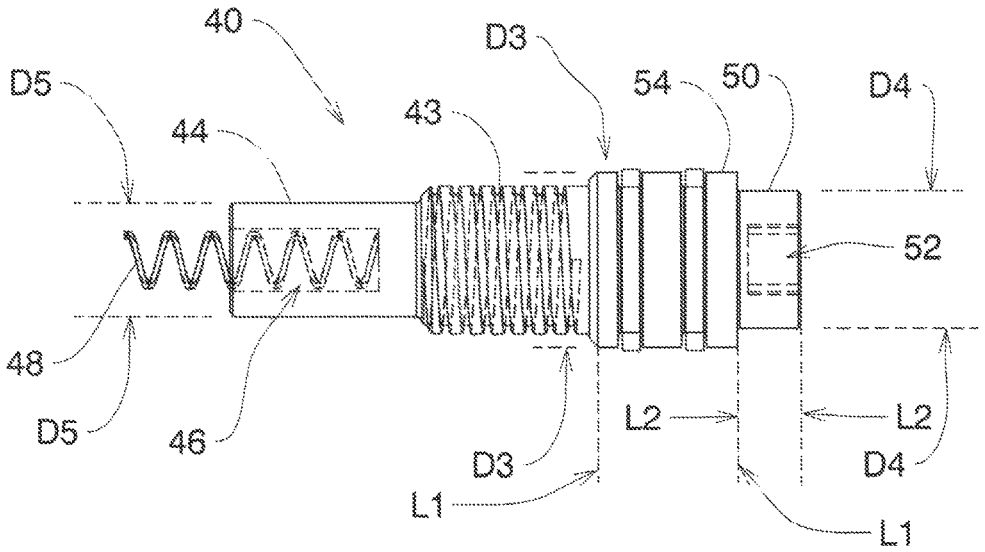
FIG. 5 is a side elevation of the bolt of FIG. 4.
Figure 6:
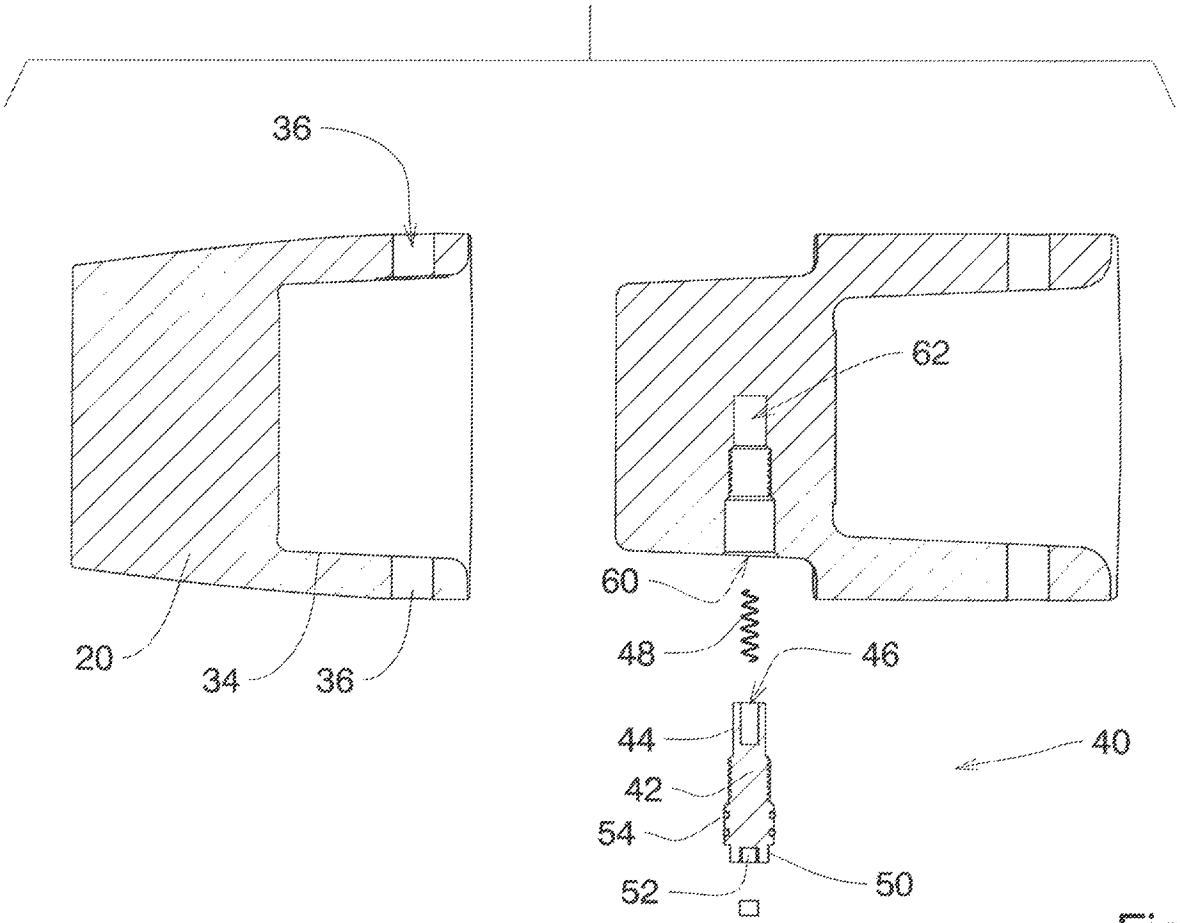
FIG. 6 is a section of an adapter and the bolt of FIGS. 4 and 5.

Another form of locking bolt (40) (FIGS. 4 and 5) has a threaded portion (42) and internal security portion (44). The security portion (44) in this embodiment has a diameter slightly less than the diameter of threaded portion (42). A recess or counter bore (46) is formed in the security portion to receive a spring (48). The outer end of the bolt (40) has a head (50) and a key (52) formed to receive any suitable rotational tool (not shown). Between the head (50) and the threaded portion (42) there is a collar (54) formed. The collar (54) has a diameter D3 greater than the diameter D4 of the head (50). The collar (54) is formed with a plurality of O-ring grooves (56). Suitable O-rings are secured in the O-rings grooves. In order to receive the bolt (40), the adapter recess (60) is formed with an inner cylindrical cavity (62) to receive the security portion (44) of the bolt. The recess (60)

has internal securing fastenings, in this case female threads to receive the threaded portion of the bolt (40). The outer end of the adapter recess has a greater diameter to receive the collar (54). In this way, when the bolt (40) is extended from the adapter recess (60), the inner security end (44) is still supported within the cavity (62). The collar (54) has the length L1 greater than the length L2 of the head (50). In this way, even when the bolt is extended from the adapter recess and the outer head portion is received in the tooth opening (70), a portion of the collar (54) is still held within the adapter recess (60). This further improves the support given to the bolt by the adapter recess (60).

The security portion (44) has a diameter D5 which is less than a diameter D3 of the collar (54), and has a length greater than the length of the collar.

In this way, when the head (50) is fully extended from the adapter recess, into the tooth opening, the collar (54) is still partially retained in the adapter recess, and the security portion (44) is still retained in its internal bore in the adapter. The bolt is thus secured in both the collar area and in the security portion area, to resist lateral stresses encountered by the bolt during operation of the shovel.

In most case tooth adapters such as described above are first of all fitted onto support bodies or noses on the shovel. In most cases these adapters themselves can be subject to wear and require replacement. For the purpose of retaining the adapters on the noses the retention device described above may possibly be used in the manner described.

Figure 7:
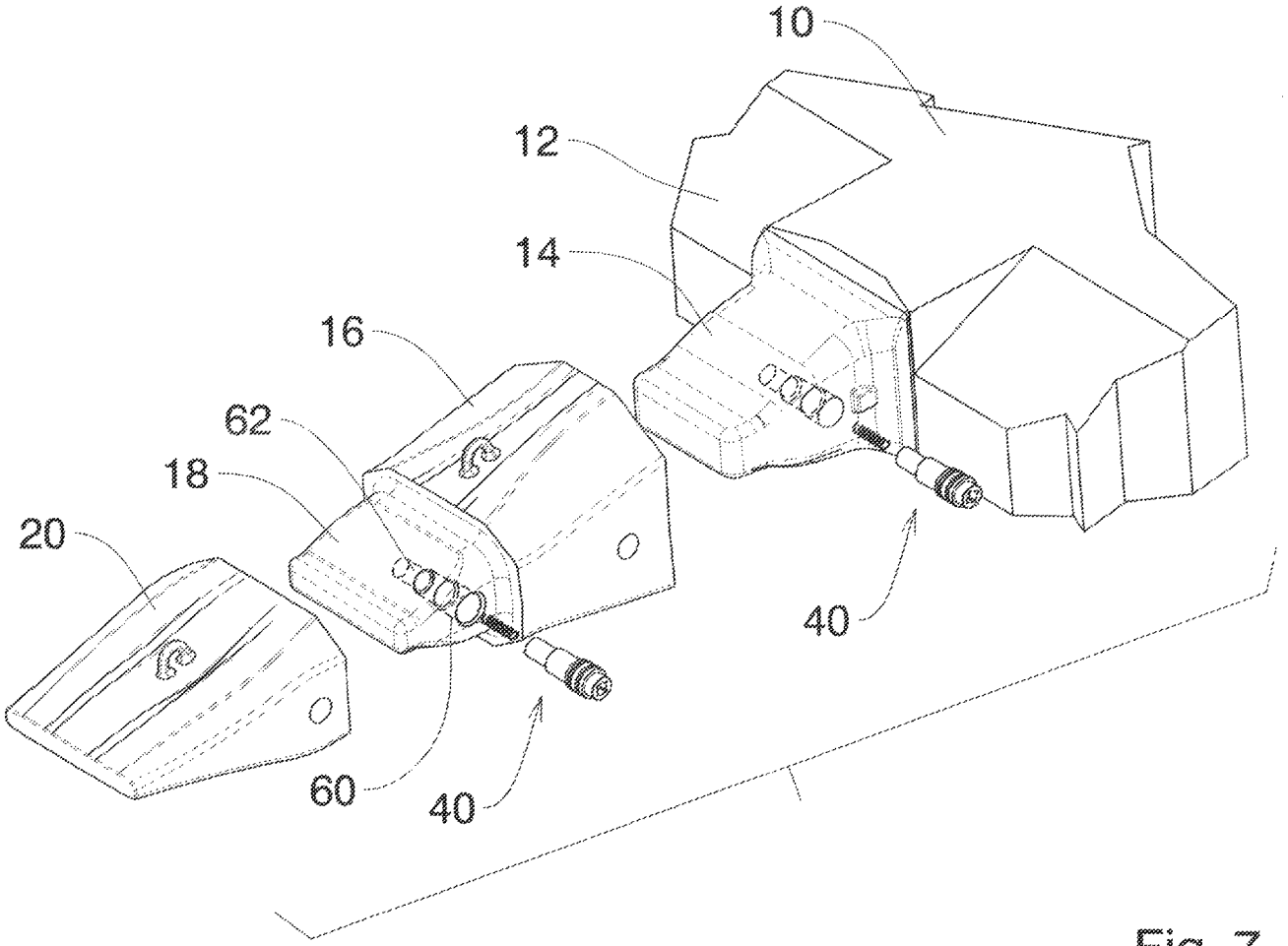
FIG. 7 is an exploded perspective of a shovel with a shovel nose adapted to use the bolt for attaching an adapter to the nose.

As explained above it is possible to use the same bolt locking system to lock an adapter (70) on the nose (72) of the shovel (FIG. 7). In this case the nose (72) of the shovel will have a nose recess (74), similar to the adapter recess and having the same features described above. The adapter (70) will have an adapter opening (76) to receive the head of the bolt.

It will thus be understood that the system can be used both for the purpose of securing the tooth on the adapter and also for securing the adapter on the nose of the shovel.

As explained, it would, of course, be necessary that each of the nose members on the shovel would necessarily be provided with the appropriate nose recess.

However this would be determined by the manufacturer of the shovel itself. Other forms of retention systems are also available for retaining the tooth adapters on the support bodies.

It is therefore understood that the term tooth retention device as used herein is intended to encompass both the retention of the teeth themselves on the adapters, but also in some cases to the retention of the adapters on the shovel support bodies as well, in cases where they are applicable.

What is claimed is:

1. An excavator tooth retention device for securing excavator teeth in position preventing inadvertent displacement and comprising;

a tooth adapter body;

a tooth adapter recess formed in said adapter body, and a female thread formed in said adapter body in the recess;

a bolt defining inner and outer ends;

a male thread formed on said inner end of said bolt adapted to be inserted in the tooth adapter recess and engage said female thread in said recess;

a bolt head formed on said outer end of said bolt and defining a security portion of a predetermined diameter;

a collar formed on the bolt of predetermined diameter greater than said bolt head security portion diameter, a counterbore in said inner end of said bolt;

a spring defining inner and outer ends, wherein said spring inner end contacts said adapter body within said adapter recess, said spring extending into said counterbore, of said bolt;

a tooth having a hollow chamber defined by tooth walls fitting over said tooth adapter;

at least one tooth bolt through opening formed in a said tooth wall of predetermined diameter, said tooth bolt opening being located to register with said adapter recess, when the tooth is positioned on the tooth adapter, and defining an open outer end to allow access of a tool; wherein said adapter recess has a predetermined internal diameter equal to said collar diameter, and wherein said tooth bolt opening in said tooth wall has a predetermined internal diameter less than said adapter recess diameter.

2. The excavator tooth retention device as claimed in claim 1 including a sealing ring fitted around said bolt in said adapter recess.

3. The excavator tooth retention device as claimed in claim 2 including a tool key formed on said bolt head for receiving a tool for rotating the bolt.

4. The excavator tooth retention device as claimed in claim 1 wherein there are two said tooth walls located on opposite sides of said tooth hollow chamber, and including tooth bolt openings extending through both said tooth walls, and defining open outer ends on both sides of said tooth.

5. The excavator tooth retention device as claimed in claim 1 wherein the bolt head security portion has a length less than the length of the bolt collar.

* * * * *